US011506206B2

(12) United States Patent
Honda et al.

(10) Patent No.: US 11,506,206 B2
(45) Date of Patent: Nov. 22, 2022

(54) COMPRESSOR HAVING CASING AND TEMPERATURE DETECTOR THEREON

(71) Applicant: DAIKIN INDUSTRIES, LTD., Osaka (JP)

(72) Inventors: Keita Honda, Osaka (JP); Makoto Adachi, Osaka (JP); Yuusuke Fujii, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 157 days.

(21) Appl. No.: 16/771,565

(22) PCT Filed: Oct. 29, 2018

(86) PCT No.: PCT/JP2018/040178
§ 371 (c)(1),
(2) Date: Jun. 10, 2020

(87) PCT Pub. No.: WO2019/123841
PCT Pub. Date: Jun. 27, 2019

(65) Prior Publication Data

US 2020/0392959 A1 Dec. 17, 2020

(30) Foreign Application Priority Data

Dec. 22, 2017 (JP) ..... JP2017-246140

(51) Int. Cl.
*F04C 18/356* (2006.01)
*F25D 29/00* (2006.01)
(Continued)

(52) U.S. Cl.
CPC ..... *F04C 28/28* (2013.01); *F04C 29/00* (2013.01); *F04C 2240/30* (2013.01); *F04C 2270/19* (2013.01)

(58) Field of Classification Search
CPC ..... F04C 28/28; F04C 29/00; F04C 2270/70; F04C 2270/19; F04C 18/3564; F25B 2600/21; F25D 29/005; F05B 2270/3032
See application file for complete search history.

(56) References Cited

U.S. PATENT DOCUMENTS 5,040,379 A * 8/1991 Fukunaga ..... G05D 23/24 62/201
7,322,806 B2 1/2008 Sun et al.
(Continued)

FOREIGN PATENT DOCUMENTS

CN 101153600 A 4/2008
EP 1 908 958 A2 4/2008
(Continued)

OTHER PUBLICATIONS

International Search Report of corresponding PCT Application No. PCT/JP2018/040178 dated Jan. 15, 2019.
(Continued)

*Primary Examiner* — Deming Wan
(74) *Attorney, Agent, or Firm* — Global IP Counselors, LLP

(57) ABSTRACT

A compressor includes a compression mechanism, a casing, and a temperature detector. The compression mechanism includes a rotation axis. The casing accommodates the compression mechanism. The casing includes a compression mechanism contact portion. The compression mechanism is in contact with an inner surface of the compression mechanism contact portion. The temperature detector is attached to an outer surface of the compression mechanism contact portion and is configured to sense temperature of the compression mechanism contact portion.

20 Claims, 7 Drawing Sheets

(51) Int. Cl.
*F04C 28/28* (2006.01)
*F04C 29/00* (2006.01)

(56) References Cited

U.S. PATENT DOCUMENTS

| | | | | |
|---|---|---|---|---|
| 2007/0154337 | A1 | 7/2007 | Sun et al. | |
| 2008/0078191 | A1 | 4/2008 | Morishita et al. | |
| 2010/0215525 | A1* | 8/2010 | Ogasawara | F04C 23/001 62/470 |
| 2016/0319816 | A1* | 11/2016 | Brostrom | F04B 49/10 |

FOREIGN PATENT DOCUMENTS

| | | | |
|---|---|---|---|
| JP | 2008-106738 | A | 5/2008 |
| JP | 2012-97755 | A | 5/2012 |

OTHER PUBLICATIONS

International Preliminary Report of corresponding PCT Application No. PCT/JP2018/040178 dated Jun. 23, 2020.
European Search Report of corresponding EP Application No. 18 89 1681.1 dated Oct. 20, 2020.

* cited by examiner

COMPRESSOR HAVING CASING AND TEMPERATURE DETECTOR THEREON

CROSS-REFERENCE TO RELATED APPLICATIONS

This U.S. National stage application claims priority under 33 U.S.C. § 119(a) to Japanese Patent Application No. 2017-246140, filed in Japan on Dec. 22, 2017, the entire contents of which are hereby incorporated herein by reference.

BACKGROUND

Field of the Invention

The present disclosure relates to a compressor included in an air conditioner.

Background Information

JP 2008-106738 A discloses a compressor. The compressor includes a casing having an outer surface provided with a discharge temperature sensor configured to detect temperature of a discharged refrigerant.

SUMMARY

JP 2008-106738 A does not refer to a temperature sensor configured to sense temperature of a compression mechanism. Sensing the temperature of the compression mechanism leads to sensing a phenomenon such as abnormal heating at the compression mechanism.

Solution to Problem

A compressor according to a first aspect includes a compression mechanism, a casing, and a temperature detector. The compression mechanism has a rotation axis. The casing accommodates the compression mechanism. The casing includes a compression mechanism contact portion. The compression mechanism is in contact with an inner surface of the compression mechanism contact portion. The temperature detector is attached to an outer surface of the compression mechanism contact portion and is configured to sense temperature of the compression mechanism contact portion.

This configuration enables sensing a phenomenon of the compression mechanism such as abnormal heating.

A compressor according to a second aspect includes a compression mechanism, a casing, and a temperature detector. The compression mechanism has a rotation axis. The casing accommodates the compression mechanism. The casing includes a compression mechanism contact portion. The compression mechanism is in contact with an inner surface of the compression mechanism contact portion. The temperature detector is attached to an outer surface of the compression mechanism contact portion. In a side view, at least 50% of a length of the compression mechanism contact portion along the rotation axis is overlapped with the temperature detector, or, in a side view, at least 50% of a length of the temperature detector along the rotation axis is overlapped with the compression mechanism contact portion.

This configuration enables sensing a phenomenon of the compression mechanism such as abnormal heating.

A compressor according to a third aspect is the compressor according to the second aspect, in which, in a side view, at least 70% of the length of the compression mechanism contact portion along the rotation axis is overlapped with the temperature detector, or, in a side view, at least 70% of the length of the temperature detector along the rotation axis is overlapped with the compression mechanism contact portion.

This configuration achieves increase of an overlapped portion between the compression mechanism contact portion and the temperature detector. In this configuration, heat emitted from the compression mechanism is more likely to be transmitted to the temperature detector that can thus further sense abnormal heating at the compression mechanism.

A compressor according to a fourth aspect is the compressor according to the third aspect, in which, in a side view, at least 90% of the length of the compression mechanism contact portion along the rotation axis is overlapped with the temperature detector, or, in a side view, at least 90% of the length of the temperature detector along the rotation axis is overlapped with the compression mechanism contact portion.

This configuration achieves increase of an overlapped portion between the compression mechanism contact portion and the temperature detector. In this configuration, heat emitted from the compression mechanism is more likely to be transmitted to the temperature detector that can thus further sense abnormal heating at the compression mechanism.

A compressor according to a fifth aspect is the compressor according to any one of the first to fourth aspects, in which the compression mechanism includes a compression mechanism extension section. The compression mechanism extension section radially extends from a center to a peripheral edge of the compression mechanism. The casing includes a compression mechanism extension section contact portion. The compression mechanism extension section contact portion is a portion of the casing in contact with the compression mechanism extension section. The temperature detector is attached to the casing so as to cover the compression mechanism extension section contact portion in a side view.

In this configuration, the temperature detector covers the compression mechanism extension section contact portion in a side view. Heat generated at the compression mechanism is thus likely to be transmitted directly to the temperature detector through the compression mechanism extension section.

A compressor according to a sixth aspect is the compressor according to any one of the first to fifth aspects, in which the compression mechanism includes a cylinder, a piston, and a head. The piston revolves around the rotation axis. The head, the cylinder, and the piston define a compression chamber. The compression mechanism contact portion of the casing is in contact with a contact member of the compression mechanism. The contact member is the cylinder or the head.

This configuration enables accurate detection of temperature of a compression mechanism included in a rotary compressor.

A compressor according to a seventh aspect is the compressor according to the sixth aspect, in which the contact member includes a continuous portion radially occupying from an outer edge of the compression chamber to the compression mechanism contact portion. The continuous portion has no opening.

In this configuration, the compression mechanism contact portion and the outer edge of the compression chamber are connected via the continuous portion of the contact member.

The continuous portion has no opening. Heat of the compression chamber is thus likely to be transmitted to the compression mechanism contact portion, enabling more accurate sensing of abnormal heating at the compression mechanism.

A compressor according to an eighth aspect is the compressor according to any one of the first to seventh aspects, in which the compression mechanism has a suction hole. A first imaginary half line starts from the rotation axis and passes a center of the suction hole in a planar view. A second imaginary half line starts from the rotation axis and passes the temperature detector in a planar view. The first imaginary half line and the second imaginary half line form an angle not less than 30 degrees and not more than 330 degrees.

This configuration secures distance between a suction pipe or a refrigerant circuit component connected to the suction pipe and the temperature detector. This inhibits defects such as decrease in detection temperature of the temperature detector by the refrigerant circuit component having low temperature.

A compressor according to a ninth aspect is the compressor according to any one of the first to eighth aspects, in which the temperature detector is configured as a thermistor.

The temperature detector in this configuration is a thermistor configured to measure temperature. The compressor can thus be controlled in accordance with measured temperature.

A compressor according to a tenth aspect is the compressor according to any one of the first to eighth aspects, in which the temperature detector is configured as a thermostat.

The temperature detector in this configuration is a thermostat configured to sense abnormal temperature. This configuration thus causes a control circuit included in the compressor to be shut down upon sensing of abnormal temperature.

DETAILED DESCRIPTION OF EMBODIMENT(S)

Description is made to a compressor according to an embodiment of the present disclosure. The embodiment to be described hereinafter specifically exemplifies the present disclosure without limiting the technical scope thereof, and can be appropriately modified within the range not departing from the purpose of the present disclosure.

(1) Entire Configuration

Figure 1:
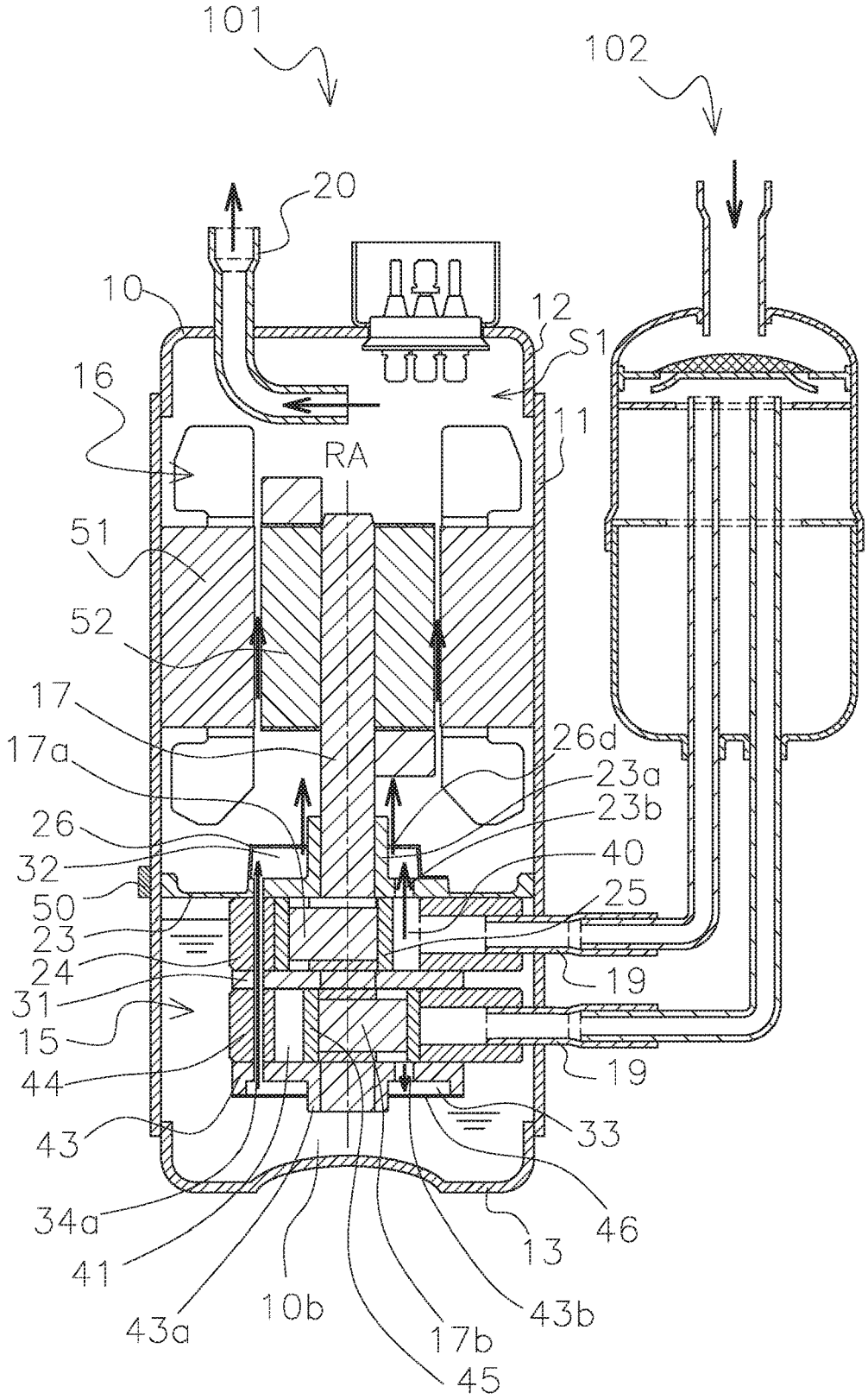
FIG. 1 is a sectional view of a compressor 101 and an accumulator 102 according to an embodiment.

FIG. 1 depicts a compressor 101 and an accumulator 102 connected to each other. FIG. 1 includes arrows each indicating a flow of a gas refrigerant. The compressor 101 is configured to compress a refrigerant. The accumulator 102 is connected to a front stage of the compressor 101. The accumulator 102 is configured to receive a refrigerant in a gas-liquid two-phase state, and reserve a liquid refrigerant while sending a gas refrigerant to the compressor 101.

(2) Detailed Configurations

The compressor 101 is configured as a two-cylinder rotary compressor. The compressor 101 includes a casing 10, a compression mechanism 15, a motor 16, a crankshaft 17, two suction pipes 19, a discharge pipe 20, and a temperature detector 50.

(2-1) Casing 10

The casing 10 includes a trunk 11, an upper portion 12, and a lower portion 13. The trunk 11 has a cylindrical shape. The upper portion 12 airtightly closes an upper opening of the trunk 11. The lower portion 13 airtightly closes a lower opening of the trunk 11.

The casing 10 accommodates the compression mechanism 15, the motor 16, and the crankshaft 17. The suction pipes 19 and the discharge pipe 20 penetrate the casing 10 and are airtightly fixed to the casing 10.

The casing 10 has an internal space including a lower portion serving as an oil reservoir 10*b* for refrigerating machine oil.

(2-2) Motor 16

The motor 16 is configured as a brushless DC motor. The motor 16 includes a stator 51 and a rotor 52. The stator 51 has a cylindrical shape and is fixed to an inner peripheral surface of the trunk 11 of the casing 10. The rotor 52 has a columnar shape and is disposed adjacent to an inner periphery of the stator 51. The stator 51 and the rotor 52 have a slight gap therebetween. The rotor 52 rotates around a rotation axis RA.

The stator 51 is provided with a coil (not depicted). The rotor 52 is provided with a plurality of magnets (not depicted). The magnets interact with a magnetic field induced by the coil to generate rotary force of the rotor 52.

(2-3) Crankshaft 17

The crankshaft 17 rotates around the rotation axis RA. The crankshaft 17 transmits the rotary force of the rotor 52 to the compression mechanism 15. The crankshaft 17 extends vertically. The crankshaft 17 has an upper end vertically penetrating the rotor 52 and fixed to the rotor 52. The crankshaft 17 has a lower portion provided with a front eccentric part 17*a* and a rear eccentric part 17*b*. The front eccentric part 17*a* and the rear eccentric part 17*b* are positioned point-symmetrically with respect to the rotation axis RA of the crankshaft 17.

(2-4) Compression Mechanism 15

The compression mechanism 15 includes a front cylinder 24, a front piston 25, a front head 23, a front muffler 26, a middle plate 31, a rear cylinder 44, a rear piston 45, a rear head 43, and a rear muffler 46.

The front cylinder 24 is disposed between the front head 23 and the middle plate 31. The front cylinder 24 has an upper surface in contact with a lower surface of the front head 23. The front cylinder 24 has a lower surface in contact with an upper surface of the middle plate 31.

The front piston 25 is also disposed between the front head 23 and the middle plate 31. The front piston 25 has an upper surface in contact with the lower surface of the front head 23. The front piston 25 has a lower surface in contact with the upper surface of the middle plate 31.

The rear cylinder 44 is disposed between the middle plate 31 and the rear head 43. The rear cylinder 44 has an upper surface in contact with a lower surface of the middle plate 31. The rear cylinder 44 has a lower surface in contact with an upper surface of the rear head 43.

The rear piston 45 is also disposed between the middle plate 31 and the rear head 43. The rear piston 45 has an upper surface in contact with the lower surface of the middle plate 31. The rear piston 45 has a lower surface in contact with the upper surface of the rear head 43.

The compression mechanism 15 includes a front compression chamber 40. The front compression chamber 40 is a space surrounded with the front cylinder 24, the front piston 25, the front head 23, and the middle plate 31.

The compression mechanism 15 further includes a rear compression chamber 41. The rear compression chamber 41 is a space surrounded with the rear cylinder 44, the rear piston 45, the rear head 43, and the middle plate 31.

The compression mechanism 15, the motor 16, and the crankshaft 17 share the rotation axis RA.

(2-4-1) Front Cylinder 24

Figure 2:
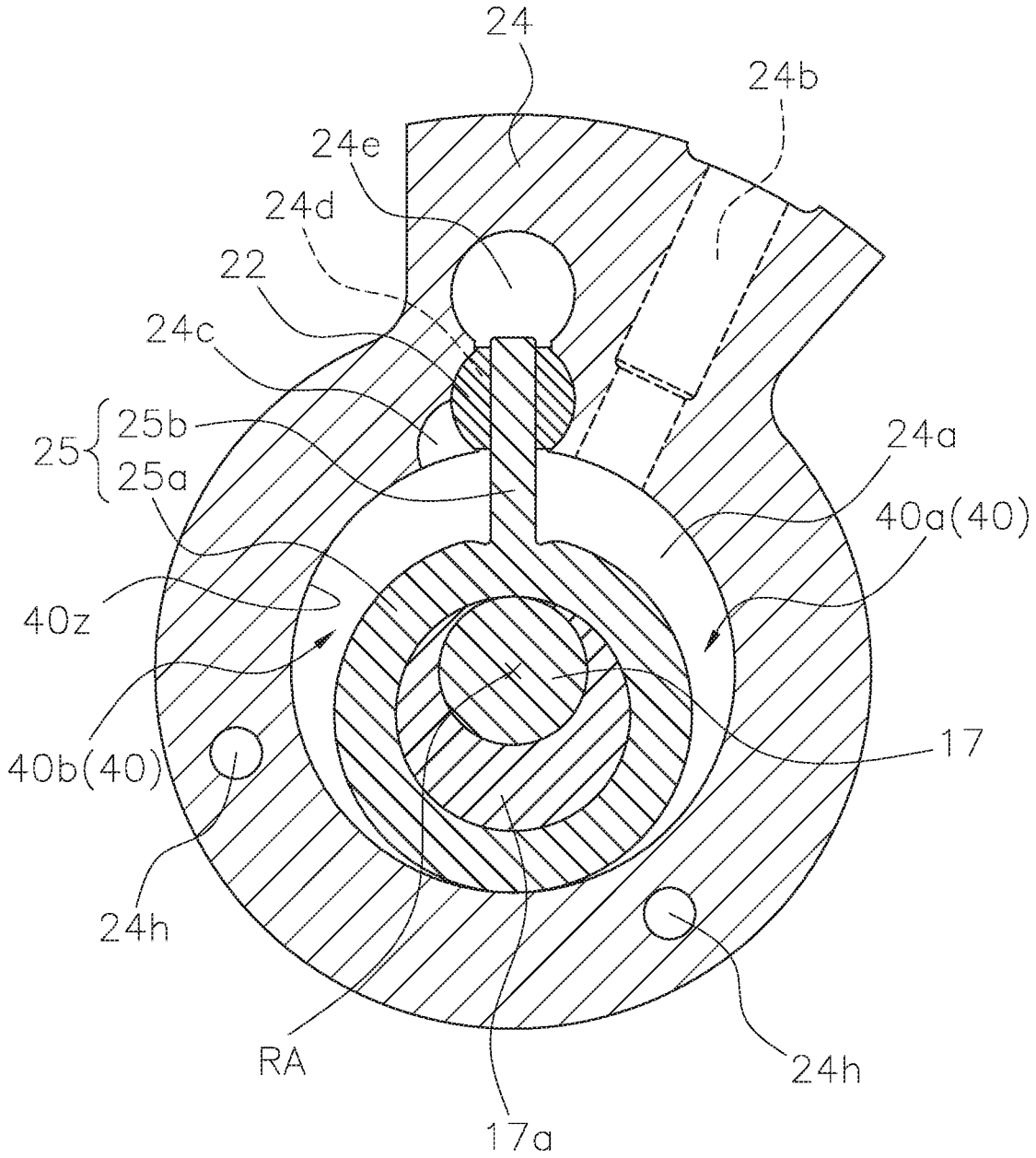
FIG. 2 is a sectional view at a height position of a front compression chamber 40 depicted in FIG. 1.

FIG. 2 is a sectional view of the compression mechanism 15 at the height of the front compression chamber 40. The front cylinder 24 is provided with a front cylinder hole 24*a*, a front suction hole 24*b*, a front discharge path 24*c*, a front bush accommodation hole 24*d*, a front blade accommodation hole 24*c*, and a front cylinder communication hole 24*h*.

The front cylinder hole 24*a* has a columnar shape and vertically penetrates the front cylinder 24. The front suction hole 24*b* radially penetrates the front cylinder 24. The front discharge path 24*c* is constituted by a cutout at an upper end of an inner circumferential surface of the front cylinder 24.

The front bush accommodation hole 24*d*, the front blade accommodation hole 24*e*, and the front cylinder communication hole 24*h* each vertically penetrate the front cylinder 24. The front bush accommodation hole 24*d* is positioned between the front suction hole 24*b* and the front discharge path 24*c* in a planar view. The front bush accommodation hole 24*d* communicates with the front cylinder hole 24*a*. The front blade accommodation hole 24*e* communicates with the front bush accommodation hole 24*d*. The front cylinder communication hole 24*h* constitutes part of a muffler space communication path 34*a* to be described later.

(2-4-2) Front Piston 25

The front piston 25 includes a front roller 25*a* and a front blade 25*b*. The front roller 25*a* has a cylindrical shape. The front blade 25*b* has a plate shape. The front blade 25*b* protrudes in a radial direction of the front roller 25*a* from an outer circumferential surface of the front roller 25*a*.

The front roller 25*a* is accommodated in the front cylinder hole 24*a*. The front roller 25*a* has a hole into which the front eccentric part 17*a* of the crankshaft 17 is fitted. The front blade 25*b* is accommodated in the front cylinder hole 24*a*, the front bush accommodation hole 24*d*, and the front blade accommodation hole 24*e*. The front bush accommodation hole 24*d* further accommodates a front bush 22. The front bush 22 includes a pair of semicolumnar members. The front roller 25*a* revolves around the rotation axis RA.

The front piston 25 divides the front compression chamber 40 into a front suction chamber 40*a* and a front discharge chamber 40*b*. The front suction chamber 40*a* communicates with the front suction hole 24*b*. The front discharge chamber 40*b* communicates with the front discharge path 24*c*. The front suction chamber 40*a* and the front discharge chamber 40*b* each have a volume varying in accordance with a position of the front piston 25.

(2-4-3) Front Head 23

With reference again to FIG. 1, the front head 23 closes the front cylinder hole 24*a*. The front head 23 is fixed to an inner peripheral surface of the casing 10.

The front head 23 includes a front bearing 23*a* supporting the crankshaft 17. The front head 23 further includes a front discharge port 23*b*. The front discharge port 23*b* communicates with the front discharge path 24*c*. The front discharge port 23*b* is a passage allowing a refrigerant compressed in the front compression chamber 40 to be sent to a front muffler space 32. The front head 23 has an upper surface to which a front discharge valve (not depicted) configured to close or open the front discharge port 23*b* is attached. The front discharge valve inhibits a backflow of a refrigerant from the front muffler space 32 to the front compression chamber 40.

(2-4-4) Front Muffler 26

Figure 3:
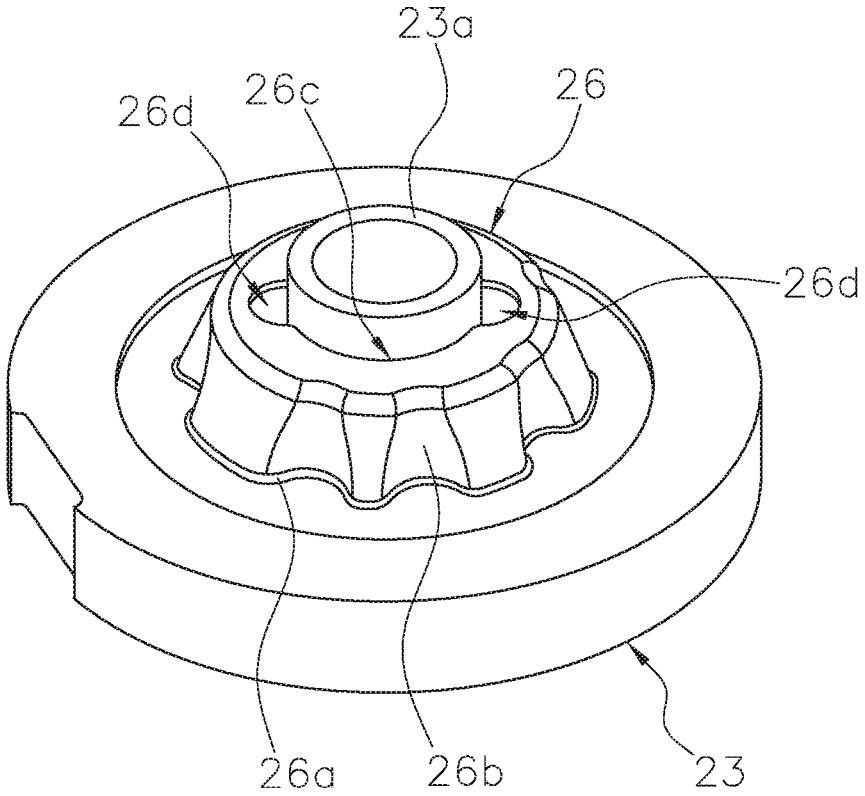
FIG. 3 is a perspective view of a front head 23 and a front muffler 26.

The front muffler 26 is fixed to the upper surface of the front head 23. The front muffler 26 and the front head 23 shape the front muffler space 32. FIG. 3 is a perspective view of the front head 23 to which the front muffler 26 is attached. The front muffler 26 includes a fixed portion 26*a* and a protrusion 26*b*. The fixed portion 26*a* is a peripheral portion fixed to the upper surface of the front head 23. The protrusion 26*b* protrudes upward from the fixed portion 26*a*. The front muffler 26 is provided to reduce noise generated when a refrigerant is discharged from the front discharge port 23*b* of the front head 23.

The front muffler 26 has a front bearing through hole 26*c*. The front bearing 23*a* of the front head 23 penetrates the front bearing through hole 26*c*. The front muffler 26 has two front muffler discharge holes 26*d*. The front muffler discharge holes 26*d* communicate with the front bearing through hole 26*c*.

(2-4-5) Middle Plate 31

The middle plate 31 depicted in FIG. 1 closes the front cylinder hole 24*a* and a rear cylinder hole 44*a* to be described later.

(2-4-6) Rear Cylinder 44

Figure 4:
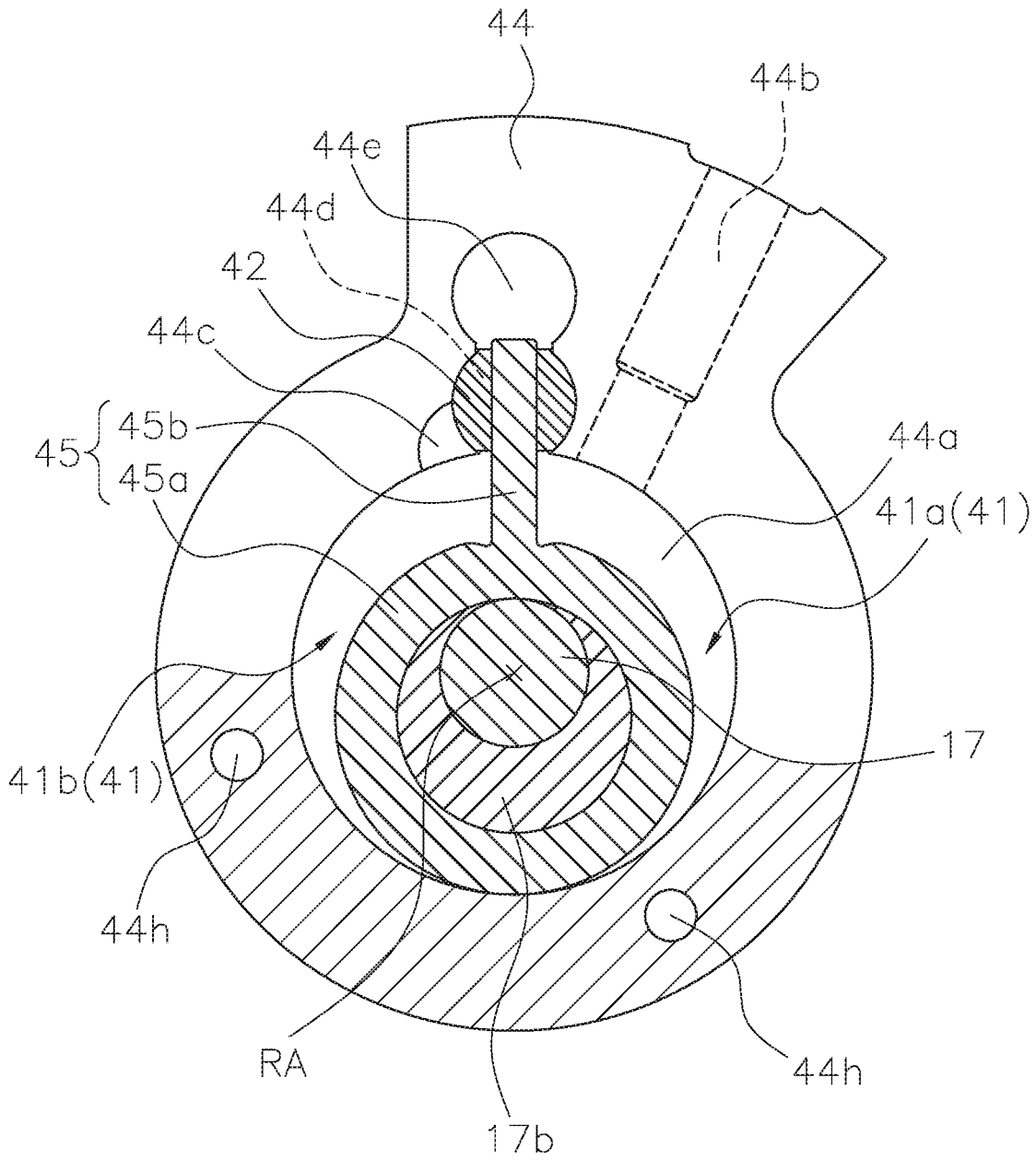
FIG. 4 is a sectional view at a height position of a rear compression chamber 41 depicted in FIG. 1.

FIG. 4 is a sectional view of the compression mechanism 15 at the height of the rear compression chamber 41. The rear cylinder 44 is provided with the rear cylinder hole 44*a*, a rear suction hole 44*b*, a rear discharge path 44*c*, a rear bush accommodation hole 44*d*, a rear blade accommodation hole 44*e*, and a rear cylinder communication hole 44*h*.

The rear cylinder hole 44*a* has a columnar shape and vertically penetrates the rear cylinder 44. The rear suction hole 44*b* radially penetrates the rear cylinder 44. The rear discharge path 44*c* is constituted by a cutout at a lower end of an inner circumferential surface of the rear cylinder 44.

The rear bush accommodation hole 44*d*, the rear blade accommodation hole 44*e*, and the rear cylinder communication hole 44*h* each vertically penetrate the rear cylinder 44. The rear bush accommodation hole 44*d* is positioned between the rear suction hole 44*b* and the rear discharge path 44*c* in a planar view. The rear bush accommodation hole 44*d* communicates with the rear cylinder hole 44*a*. The rear blade accommodation hole 44*e* communicates with the rear bush accommodation hole 44*d*. The rear cylinder communication hole 44*h* constitutes part of the muffler space communication path 34*a* to be described later.

(2-4-7) Rear Piston 45

The rear piston 45 includes a rear roller 45*a* and a rear blade 45*b*. The rear roller 45*a* has a cylindrical shape. The rear blade 45*b* has a plate shape. The rear blade 45*b* protrudes in a radial direction of the rear roller 45*a* from an outer circumferential surface of the rear roller 45*a*.

The rear roller 45*a* is accommodated in the rear cylinder hole 44*a*. The rear roller 45*a* has a hole into which the rear eccentric part 17*b* of the crankshaft 17 is fitted. The rear blade 45*b* is accommodated in the rear cylinder hole 44*a*, the rear bush accommodation hole 44*d*, and the rear blade accommodation hole 44*e*. The rear bush accommodation hole 44*d* further accommodates a rear bush 42. The rear bush 42 includes a pair of semicolumnar members. The rear roller 45*a* revolves around the rotation axis RA.

The rear piston 45 divides the rear compression chamber 41 into a rear suction chamber 41*a* and a rear discharge chamber 41*b*. The rear suction chamber 41*a* communicates with the rear suction hole 44*b*. The rear discharge chamber 41*b* communicates with the rear discharge path 44*c*. The rear suction chamber 41*a* and the rear discharge chamber 41*b* each have a volume varying in accordance with a position of the rear piston 45.

(2-4-8) Rear Head 43

With reference again to FIG. 1, the rear head 43 closes the rear cylinder hole 44*a*. The rear head 43 includes a rear bearing 43*a* supporting the crankshaft 17. The rear head 43 further includes a rear discharge port 43*b*. The rear discharge port 43*b* communicates with the rear discharge path 44*c*. The rear discharge port 43*b* is a passage allowing a refrigerant compressed in the rear compression chamber 41 to be sent to a rear muffler space 33.

The rear head 43 has a lower surface to which a rear discharge valve (not depicted) configured to close or open the rear discharge port 43*b* is attached. The rear discharge valve inhibits a backflow of a refrigerant from the rear muffler space 33 to the rear compression chamber 41.

Figure 5:
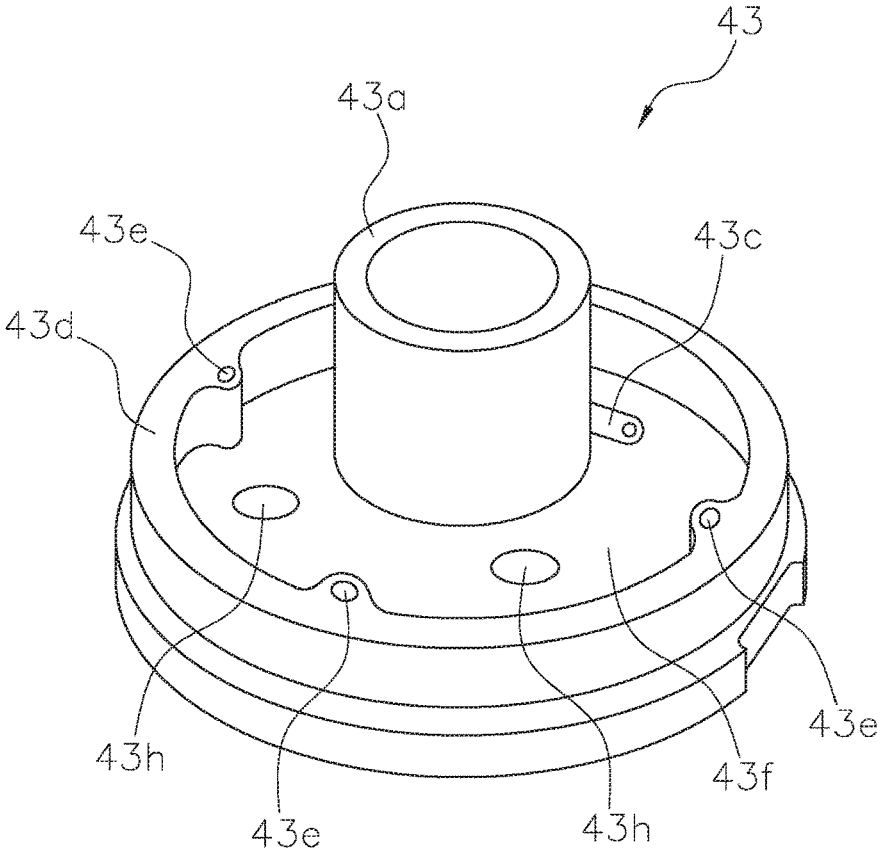
FIG. 5 is a perspective view of a rear head 43.

FIG. 5 is a perspective view of the rear head 43. The rear head 43 has a side wall 43*d*. The side wall 43*d* is an annular portion provided at an outer edge of the lower surface of the rear head 43. The side wall 43*d* is smaller in height than the rear bearing 43*a*. The side wall 43*d* has a plurality of muffler fastening holes 43*e*. The muffler fastening holes 43*e* each allow a bolt to pass in order to fix the rear muffler 46 to the rear head 43.

The rear head 43 has a muffler bottom surface 43*f* and a rear head communication hole 43*h*. The muffler bottom surface 43*f* constitutes the lower surface of the rear head 43 positioned between the side wall 43*d* and the rear bearing 43*a*. The rear head communication hole 43*h* opens in the muffler bottom surface 43*f*. The rear head communication hole 43*h* constitutes part of the muffler space communication path 34*a* to be described later. The muffler bottom surface 43*f* is provided with a rear discharge valve 43*c*.

(2-4-9) Rear Muffler 46

With reference again to FIG. 1, the rear muffler 46 is fixed, by a bolt, to a lower surface of the side wall 43*d* of the rear head 43. The rear muffler 46 is a plate-shaped member. The rear muffler 46 reduces noise generated when a refrigerant is discharged from the rear discharge port 43*b*.

The rear muffler 46 has a rear bearing through hole penetrated by the rear bearing 43*a* of the rear head 43. The rear muffler 46 covers the lower surface of the rear head 43 such that the rear muffler 46 and the rear head 43 form the rear muffler space 33. The rear muffler space 33 has a substantially annular shape.

(2-4-10) Muffler Space Communication Path 34*a*

The compression mechanism 15 includes the muffler space communication path 34*a*. The muffler space communication path 34*a* allows the front muffler space 32 and the rear muffler space 33 to communicate with each other. As depicted in FIG. 1, the muffler space communication path 34*a* penetrates the front head 23, the front cylinder 24, the middle plate 31, the rear cylinder 44, and the rear head 43. The muffler space communication path 34*a* includes the front cylinder communication hole 24*h*, the rear cylinder communication hole 44*h*, and the rear head communication hole 43*h*.

(2-5) Suction Pipes 19

The suction pipes 19 allow a refrigerant to be supplied from a refrigerant circuit to the compression mechanism 15. The two suction pipes 19 are respectively connected to the front suction hole 24*b* and the rear suction hole 44*b*. The two suction pipes 19 are connected to the accumulator 102.

(2-6) Discharge Pipe 20

The discharge pipe 20 allows a refrigerant compressed by the compression mechanism 15 to be supplied to the refrigerant circuit. The discharge pipe 20 has a first end positioned above the motor 16 in the internal space of the casing 10. The discharge pipe 20 has a second end connected to the refrigerant circuit in a space outside the casing 10.

(2-7) Temperature Detector 50

The temperature detector 50 is configured to sense temperature of an object in contact. The temperature detector 50 may be exemplified by a thermistor. The compressor 101 may be stopped by a control device when the thermistor outputs temperature exceeding a predetermined threshold.

The temperature detector 50 may alternatively be configured as a thermostat. Specifically, when the thermostat senses temperature exceeding a predetermined threshold, power supply to the compressor may be interrupted. Examples of the thermostat may include a bimetal thermostat. The examples of the thermostat may further include an overload relay and a thermal relay.

Figure 6:
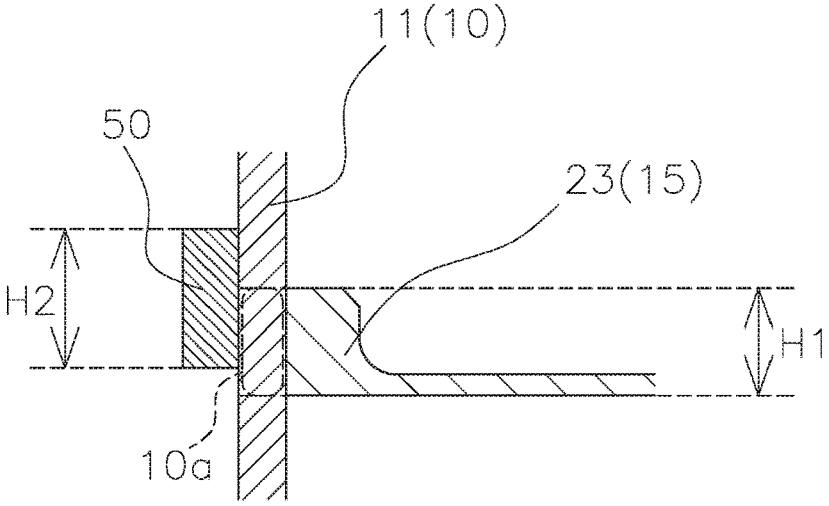
FIG. 6 is an enlarged view on a position where a temperature detector 50 is attached.

The temperature detector 50 is attached to an outer surface of the trunk 11 of the casing 10 in order to acquire temperature of the compression mechanism 15. FIG. 6, FIG.

Figure 8:
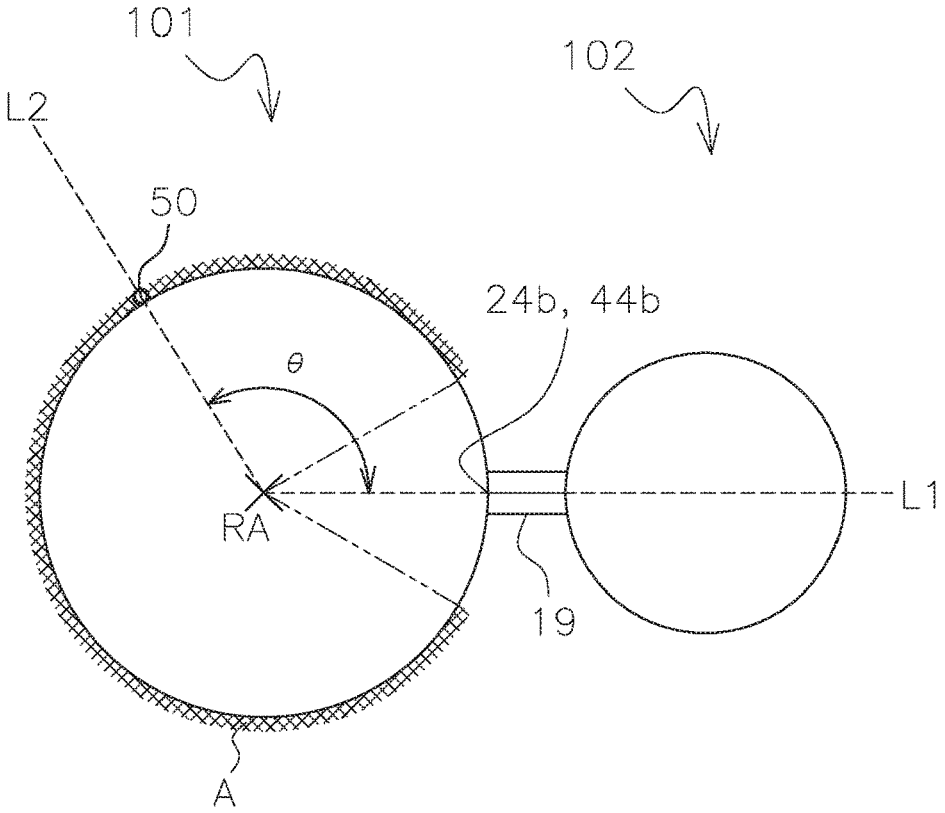
FIG. 8 is a schematic plan view of the compressor 101 and the accumulator 102.
Figure 9:
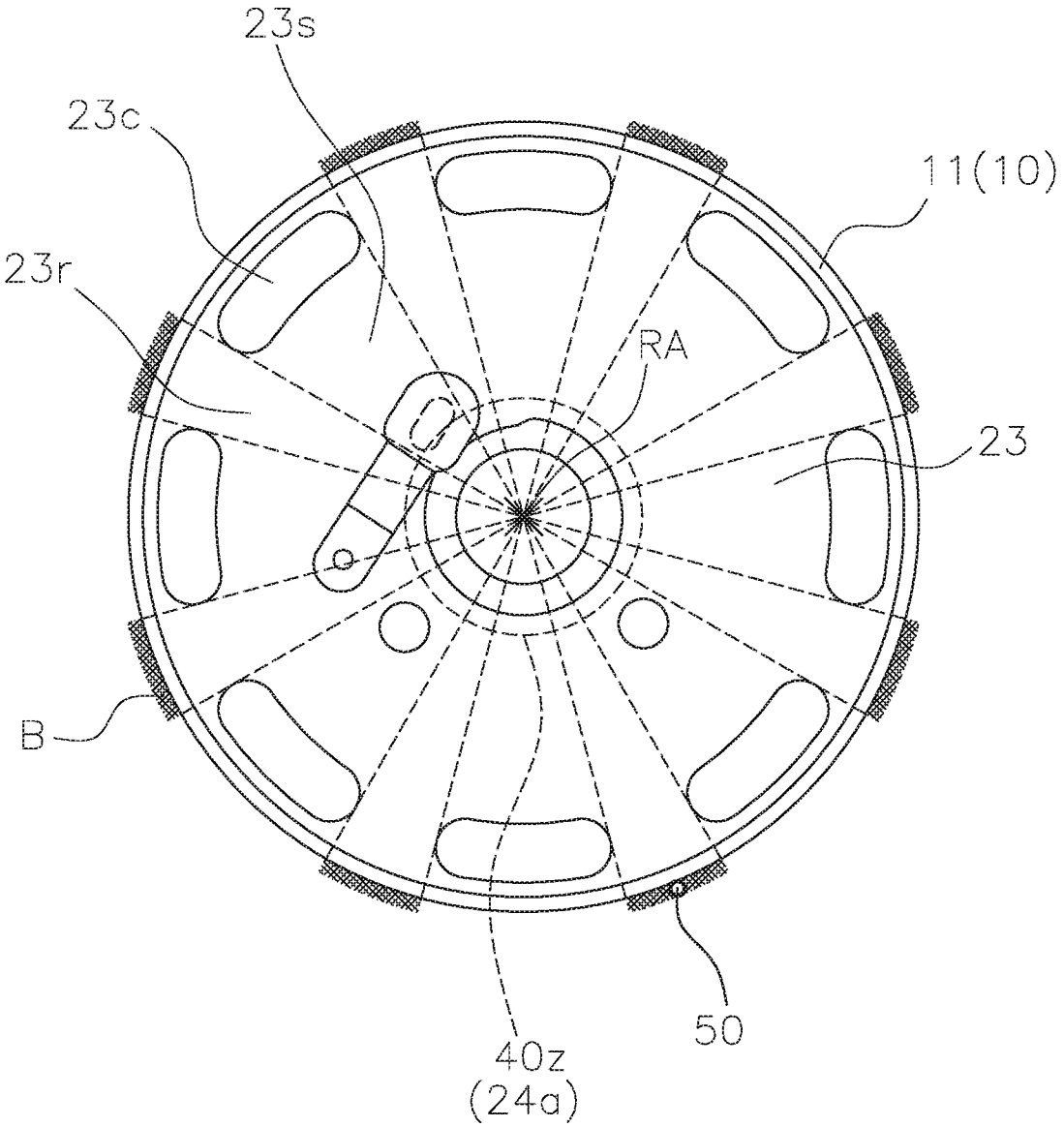
FIG. 9 is a plan view of the front head 23.

7, FIG. 8, and FIG. 9 are explanatory views on a position where the temperature detector 50 is attached.

As depicted in FIG. 6, the temperature detector 50 is attached to an outer surface of a compression mechanism contact portion 10*a*. The compression mechanism contact portion 10*a* of the casing 10 is in contact with the compression mechanism 15. The compression mechanism contact portion 10*a* according to the present embodiment is a portion of the trunk 11 whose inner surface is in contact with the front head 23. In a side view, the compression mechanism contact portion 10*a* has a length H1 that is along the rotation axis RA and is at least partially overlapped with a length H2, along the rotation axis RA, of the temperature detector 50. For example, at least 50% of the length H1 is overlapped with the length H2, or at least 50% of the length H2 is overlapped with the length H1. Preferably, at least 70% of the length H1 is overlapped with the length H2, or at least 70% of the length H2 is overlapped with the length H1. More preferably, at least 90% of the length H1 is overlapped with the length H2, or at least 90% of the length H2 is overlapped with the length H1.

Figure 7:
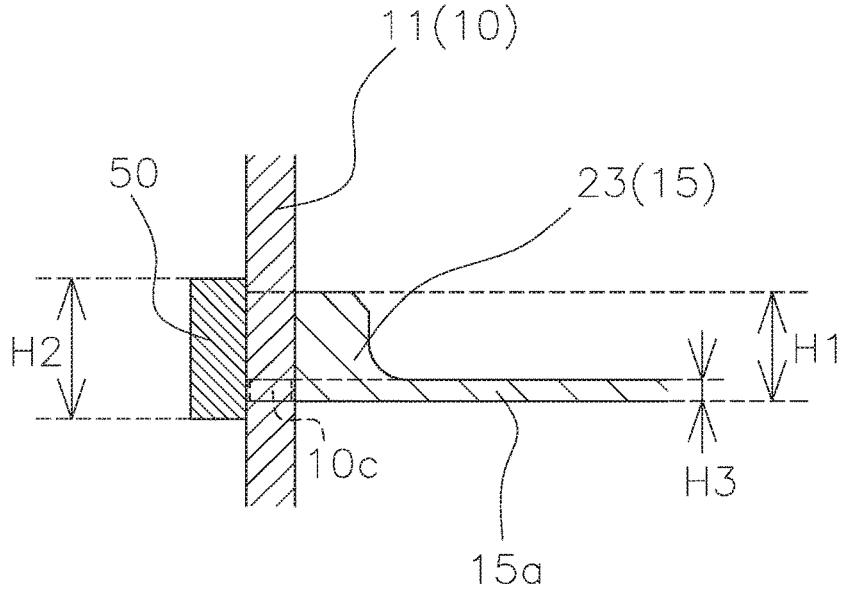
FIG. 7 is another enlarged view on the position where the temperature detector 50 is attached.

It is preferred that, as depicted in FIG. 7, the temperature detector 50 is attached so as to cover the compression mechanism extension section contact portion 10*c* in a side view. The compression mechanism extension section contact portion 10*c* of the casing 10 is in contact with a compression mechanism extension section 15*a*. The compression mechanism extension section 15*a* radially extends from a center to a peripheral edge of the compression mechanism 15. The center of the compression mechanism 15 corresponds to a portion, which is positioned at a center of the internal space of the casing 10, of a member constituting a wall surface of the compression chamber (the front compression chamber 40, the rear compression chamber 41), a member in contact with the member constituting the wall surface of the compression chamber, or the like. Examples of the center of the compression mechanism 15 include a center of the front head 23 and an inner circumferential portion of a cylinder (the front cylinder 24, the rear cylinder 44). The peripheral edge of the compression mechanism 15 is a portion of the compression mechanism 15 in contact with the casing 10, and examples of the peripheral edge of the compression mechanism 15 include an outer edge of the front head 23 (in a case where the front head 23 is in contact with the casing 10) and an outer edge of the cylinder (in a case where the cylinder is in contact with the casing 10). The compression mechanism extension section 15*a* according to the present embodiment constitutes part of the front head 23. The compression mechanism extension section 15*a* has a thickness H3.

FIG. 8 is a schematic plan view of the compressor 101 and the accumulator 102. The accumulator 102 is connected to the compressor 101 via the two suction pipes 19. The two suction pipes 19 are respectively connected to the front suction hole 24*b* and the rear suction hole 44*b* of the compression mechanism 15. This figure includes a first imaginary half line L1 and a second imaginary half line L2. The first imaginary half line L1 starts from the rotation axis RA and passes centers of the front suction hole 24*b* and the rear suction hole 44*b* in a planar view. The second imaginary half line L2 starts from the rotation axis RA and passes the temperature detector 50 in a planar view. The first imaginary half line L1 and the second imaginary half line L2 form an angle θ not less than 30 degrees and not more than 330 degrees. That is, the temperature detector 50 is attached to any point in an area A indicated in the figure. Assume that the angle θ increases counterclockwise from the first imaginary half line L1 to the second imaginary half line L2.

FIG. 9 is a plan view of the compression mechanism 15 along with a section of the trunk 11. The front head 23 includes a continuous portion 23*r* and a discontinuous portion 23*s*. The continuous portion 23*r* radially occupies from an outer edge 40*z* of the front compression chamber 40 to the casing 10. In the discontinuous portion 23*s*, the casing 10 is separated from the outer edge 40*z* of the compression chamber 40 by an oil return hole 23*c*. The outer edge 40*z* of the compression chamber 40 agrees with an outline of the front cylinder hole 24*a*. The oil return hole 23*c* is an opening that allows refrigerating machine oil in a high-pressure space S1 to return to the oil reservoir 10*b*. The temperature detector 50 is attached to an outer surface of a portion, which is in contact with the continuous portion 23*r*, of the compression mechanism contact portion 10*a* of the casing 10. That is, the temperature detector 50 is attached to any point in an area B indicated in the figure.

(3) Basic Operation

(3-1) Driving Motor 16

The motor 16 being energized rotates the crankshaft 17 along with the rotor 52. The front eccentric part 17*a* and the rear eccentric part 17*b* eccentrically rotate around the rotation axis RA of the crankshaft 17. This causes revolution of the front piston 25 and the rear piston 45.

(3-2) Refrigerant Compression in Front Compression Chamber 40

While the front piston 25 revolves, the outer circumferential surface of the front roller 25*a* is in contact with the inner circumferential surface of the front cylinder 24. The front blade 25*b* reciprocates while being supported by the front bush 22 at the opposite sides. The front bush 22 swings in the front bush accommodation hole 24*d* while being sliding with respect to the front cylinder 24 and the front blade 25*b*.

Revolution of the font roller 25*a* gradually increases the volume of the front suction chamber 40*a*. This causes a refrigerant having low pressure to be sucked from the suction pipe 19 into the front suction chamber 40*a*. Further revolution of the front roller 25*a* causes the front suction chamber 40*a* to become the front discharge chamber 40*b*. The volume of the front discharge chamber 40*b* gradually decreases, so that the refrigerant having low pressure in the front discharge chamber 40*b* is compressed to become a refrigerant having high pressure. The refrigerant having high pressure is discharged into the front muffler space 32 via the front discharge path 24*c* and the front discharge port 23*b*. The front muffler space 32 periodically receives the refrigerant having high pressure from the front discharge port 23*b*.

(3-3) Refrigerant Compression in Rear Compression Chamber 41

While the rear piston 45 revolves, the outer circumferential surface of the rear roller 45*a* is in contact with the inner circumferential surface of the rear cylinder 44. The rear blade 45*b* reciprocates while being supported by the rear bush 42 at the opposite sides. The rear bush 42 swings in the rear bush accommodation hole 44*d* while being sliding with respect to the rear cylinder 44 and the rear blade 45*b*.

Revolution of the rear roller 45*a* gradually increases the volume of the rear suction chamber 41*a*. This causes a refrigerant having low pressure to be sucked from the suction pipe 19 into the rear suction chamber 41*a*. Further revolution of the rear roller 45*a* causes the rear suction chamber 41*a* to become the rear discharge chamber 41*b*. The volume of the rear discharge chamber 41*b* gradually decreases, so that the refrigerant having low pressure in the rear discharge chamber 41*b* is compressed to become a refrigerant having high pressure. The refrigerant having high pressure is discharged into the rear muffler space 33 via the rear discharge path 44*c* and the rear discharge port 43*b*. The rear muffler space 33 periodically receives the refrigerant having high pressure from the rear discharge port 43*b*.

(3-4) Movement of Refrigerant Having been Discharged

The refrigerant discharged into the rear muffler space 33 flows in the rear muffler space 33 and enters the muffler space communication path 34*a*. The refrigerant then flows into the front muffler space 32. The refrigerant in the front muffler space 32 passes the front muffler discharge holes 26*d* of the front muffler 26 and is supplied into the high-pressure space S1 in the casing 10. The refrigerant supplied into the high-pressure space S1 flows upward to be supplied to the discharge pipe 20.

(4) Characteristics 4-1

The temperature detector 50 is configured to measure temperature of the compression mechanism contact portion 10*a* of the casing 10. The compression mechanism contact portion 10*a* is in contact with the compression mechanism 15. The temperature detector 50 can thus sense abnormal heating at the compression mechanism 15.

4-2

This configuration secures an overlapped portion of the compression mechanism contact portion 10*a* and the temperature detector 50. The overlapped portion has a length that may be at least 50%, at least 70%, or at least 90% of the length of the compression mechanism contact portion 10*a* or the temperature detector 50. In this configuration, heat emitted from the compression mechanism 15 is likely to be transmitted to the temperature detector 50 that can thus sense abnormal heating at the compression mechanism 15.

4-3

The temperature detector 50 can be configured to cover the compression mechanism extension section contact portion 10*c* in a side view. Heat generated at the compression mechanism 15 is thus likely to be transmitted directly to the temperature detector 50 through the compression mechanism extension section 15*a*.

4-4

Temperature of the compression mechanism 15 is detected accurately in the rotary compressor.

4-5

The compression mechanism contact portion 10*a* and the outer edge 40*z* of the front compression chamber 40 are connected via the continuous portion 23*r* of the front head 23. The continuous portion 23*r* has no oil return hole 23*c*. Heat of the compression mechanism 15 is thus likely to be transmitted to the compression mechanism contact portion 10*a*, enabling more accurate sensing of abnormal heating at the compression mechanism 15.

4-6

This configuration secures distance between the suction pipe 19 or the accumulator 102 connected to the suction pipe 19 and the temperature detector 50. This inhibits defects such as decrease in detection temperature of the temperature detector 50 by the accumulator 102 having low temperature.

4-7

In the case where the temperature detector 50 is configured as a thermistor, the compressor 101 can be controlled in accordance with measured temperature. In the case where the temperature detector 50 is configured as a thermostat, a control circuit of the compressor 101 can be shut down upon sensing of abnormal temperature.

(5) Modification Examples (5-1) Modification Example A

The compressor 101 according to the embodiment described above is configured as a two-cylinder rotary compressor. The compressor 101 may alternatively be of a different type. The compressor 101 may be configured as a single-cylinder rotary compressor, a multistage rotary compressor other than a two-stage type, a scroll compressor, or the like.

(5-2) Modification Example B

The compression mechanism 15 according to the above embodiment includes a contact member that is in contact with the casing 10 and corresponds to the front head 23. The contact member may alternatively be a component other than the front head 23. For example, the contact member may constitute at least part of the front cylinder 24, the rear cylinder 44, or the rear head 43.

The compression mechanism extension section 15*a* may also be the front cylinder 24, the rear cylinder 44, the rear head 43, or the like, instead of the front head 23.

(6) Conclusion

The embodiment of the present disclosure has been described above. Various modifications to modes and details should be available without departing from the purpose and the scope of the present disclosure recited in the claims.

REFERENCE SIGNS LIST

10: casing
10*a*: compression mechanism contact portion
10*c*: compression mechanism extension section contact portion
15: compression mechanism
15*a*: compression mechanism extension section
23: front head
23*r*: continuous portion
23*s*: discontinuous portion

24: front cylinder
24*a*: front cylinder hole
24*b*: front suction hole
24*c*: front discharge path
25: front piston
40: front compression chamber
40*z*: outer edge
41: rear compression chamber
43: rear head
50: temperature detector
101: compressor
102: accumulator

CITATION LIST

Patent Literature

[Patent Literature 1] JP 2008-106738 A

What is claimed is:

1. A compressor comprising:
a compression mechanism having a rotation axis;
a casing accommodating the compression mechanism; and
a temperature detector,
the casing including a compression mechanism contact portion,
the compression mechanism being in contact with an inner surface of the casing at the compression mechanism contact portion, the compression mechanism having a discharge opening that is disposed closer to the rotation axis than to the inner surface of the casing, and
the temperature detector being attached to an outer surface of the compression mechanism contact portion, and the temperature detector being configured to sense temperature of the compression mechanism contact portion.

2. The compressor according to claim 1, wherein
the compression mechanism includes a compression mechanism extension section,
the compression mechanism extension section radially extends from a center to a peripheral edge of the compression mechanism,
the casing includes a compression mechanism extension section contact portion,
the compression mechanism extension section contact portion of the casing is in contact with the compression mechanism extension section, and
the temperature detector is attached to the casing so as to cover the compression mechanism extension section contact portion in a side view.

3. The compressor according to claim 2, wherein
the compression mechanism includes
a cylinder,
a piston configured to revolve around the rotation axis, and
a head defining, along with the cylinder and the piston, a compression chamber,
the compression mechanism extension section contact portion of the casing is in contact with a contact member of the compression mechanism, and
the contact member is the cylinder or the head.

4. The compressor according to claim 3, wherein
the contact member includes a continuous portion radially occupying from an outer edge of the compression chamber to the compression mechanism contact portion, and
the continuous portion has no opening.

5. The compressor according to claim 1, wherein
the compression mechanism has a suction hole,
a first imaginary half line starts from the rotation axis and passes a center of the suction hole in a planar view,
a second imaginary half line starts from the rotation axis and passes the temperature detector in the planar view, and
the first imaginary half line and the second imaginary half line form an angle not less than 30 degrees and not more than 330 degrees.

6. The compressor according to claim 1, wherein
the temperature detector is a thermistor.

7. The compressor according to claim 1, wherein
the temperature detector is a thermostat.

8. The compressor according to claim 1, wherein
the discharge opening is oriented to discharge the refrigerant in a direction parallel to the rotation axis.

9. The compressor according to claim 1, wherein
the compression mechanism includes a front muffler disposed on a discharge side of the compression mechanism, and
the discharge opening is a front muffler discharge hole provided in the front muffler.

10. A compressor comprising:
a compression mechanism having a rotation axis;
a casing accommodating the compression mechanism; and
a temperature detector,
the casing including a compression mechanism contact portion,
the compression mechanism being in contact with an inner surface of the casing at the compression mechanism contact portion, the compression mechanism having a discharge opening that is disposed closer to the rotation axis than to the inner surface of the casing, the temperature detector being attached to an outer surface of the compression mechanism contact portion, and the temperature detector being configured to sense temperature of the compression mechanism contact portion, and
in a side view,
at least 50% of a length of the compression mechanism contact portion along the rotation axis being overlapped with the temperature detector in a side view, or
at least 50% of a length of the temperature detector along the rotation axis being overlapped with the compression mechanism contact portion.

11. The compressor according to claim 10, wherein
in a side view,
at least 70% of the length of the compression mechanism contact portion along the rotation axis is overlapped with the temperature detector, or
at least 70% of the length of the temperature detector along the rotation axis is overlapped with the compression mechanism contact portion.

12. The compressor according to claim 11, wherein
in a side view,
at least 90% of the length of the compression mechanism contact portion along the rotation axis is overlapped with the temperature detector, or
at least 90% of the length of the temperature detector along the rotation axis is overlapped with the compression mechanism contact portion.

13. The compressor according to claim 10, wherein
the compression mechanism includes a compression mechanism extension section, the compression mechanism extension section radially extends from a center to a peripheral edge of the compression mechanism, the casing includes a compression mechanism extension section contact portion, the compression mechanism extension section contact portion of the casing is in contact with the compression mechanism extension section, and the temperature detector is attached to the casing so as to cover the compression mechanism extension section contact portion in a side view.

14. The compressor according to claim 13, wherein the compression mechanism includes a cylinder, a piston configured to revolve around the rotation axis, and a head defining, along with the cylinder and the piston, a compression chamber, the compression mechanism extension section contact portion of the casing is in contact with a contact member of the compression mechanism, and the contact member is the cylinder or the head.

15. The compressor according to claim 14, wherein the contact member includes a continuous portion radially occupying from an outer edge of the compression chamber to the compression mechanism contact portion, and the continuous portion has no opening.

16. The compressor according to claim 10, wherein the compression mechanism has a suction hole, a first imaginary half line starts from the rotation axis and passes a centerof the suction hole in a planar view, a second imaginary half line starts from the rotation axis and passes the temperature detector in the planar view, and the first imaginary half line and the second imaginary half line form an angle not less than 30 degrees and not more than 330 degrees.

17. The compressor according to claim 10, wherein the temperature detector is a thermistor.

18. The compressor according to claim 10, wherein the temperature detector is a thermostat.

19. The compressor according to claim 10, wherein the discharge opening is oriented to discharge the refrigerant in a direction parallel to the rotation axis.

20. The compressor according to claim 10, wherein the compression mechanism includes a front muffler disposed on a discharge side of the compression mechanism, and the discharge opening is a front muffler discharge hole provided in the front muffler.

* * * * *